United States Patent [19]

Hepworth

[11] 4,203,682

[45] May 20, 1980

[54] INSERT MOLDED INSTRUMENT MARKER PEN WITH ANCHORED STYLUS

[75] Inventor: William W. Hepworth, Haddonfield, N.J.

[73] Assignee: Graphic Controls Corporation, Cherry Hill, N.J.

[21] Appl. No.: 922,840

[22] Filed: Jul. 10, 1978

[51] Int. Cl.[2] ..... B43K 1/12

[52] U.S. Cl. ..... 401/198; 401/292; 346/140 A; 29/460; 264/271

[58] Field of Search ..... 401/198, 265, 88, 292; 346/140 A, 140 R; 29/460; 264/259, 271, 279

[56] References Cited

U.S. PATENT DOCUMENTS

| | | | |
|---|---|---|---|
| 2,902,977 | 9/1959 | Shurchliff | 401/88 |
| 3,061,888 | 11/1962 | Wadham | 264/279 |
| 3,090,357 | 5/1963 | Granley | 346/140 |
| 3,120,215 | 2/1964 | Scalo et al. | 346/140 A |
| 3,216,171 | 11/1965 | Jenkins | 264/279 |
| 3,764,066 | 10/1973 | Kowell | 264/271 |
| 3,804,540 | 4/1974 | Mutschler | 401/265 |
| 4,091,068 | 5/1978 | Karas | 264/274 |
| 4,106,182 | 8/1978 | Blackwell | 29/460 |

*Primary Examiner*—William Pieprz

*Attorney, Agent, or Firm*—Miller & Prestia

[57] ABSTRACT

Insert molded instrument marker pen with a stylus tube firmly secured therein by the provision thereon of an anchoring projection embedded in the insert molded body of the marker. Preferably, the anchoring projection includes a "U-shaped" portion conforming to a section of the outer surface of the tube and outwardly extending flanges at the top of the U-shaped portion, the projection being metal and being welded to a metal stylus tube.

10 Claims, 4 Drawing Figures

INSERT MOLDED INSTRUMENT MARKER PEN WITH ANCHORED STYLUS

This invention pertains to instrument marker pens, typically having molded plastic bodies and often including insert molded stylus tubes. More particularly, this invention pertains to such markers in which, notwithstanding the small size and close dimensional tolerances thereof, the insert molded stylus tube is securely fixed in the marker body.

Recording instruments, in which an instrument reading is graphically reported by a trace line on a moving chart over a period of time commonly include a pen (in which the writing element is a metal tip or ball) or marker (in which a fibrous reservoir and porous nib are typically used). These devices will be generically referred to herein as "instrument marker pens". As recording instruments have become more and more compact, it has been necessary to devise smaller and simpler instrument marker pens.

Because of their small size and close dimensional tolerances, such pens have developed as a separate branch of the general writing pen art. In contrast to pens in general which are usually intended to be hand held, instrument marker pens for newer recording instruments are often less than an inch in many of their overall outer dimensions. Notwithstanding this small size, complex geometric details must often be included in these pens to assist in visual observation of pen position, reliable attachment of ink delivery means, reliable positioning of the pen and ease of maintenance and replacement.

Thus, one common form of instrument marker pen is that in which the pen body is a small plastic piece, from which a writing nib or ink stylus tube projects. Commonly also, the ink stylus tube is insert molded in the plastic body for ease of manufacture and proper positioning of the stylus tube.

As used herein, the term "stylus tube" or "ink stylus tube", refers tp a tube, often of metal construction, through which ink is transported from a reservoir, often located in the pen body, to a writing nib, which may consist of a reduced diameter end segment of the tube or which may consist of a porous writing nib friction fit or otherwise held in the projecting end of the tube. Still further, the stylus tube may include an ink wicking material within the tube along the length thereof to conduct ink from an ink reservoir at one end of the tube to a writing nib at the other end of the tube.

The term "insert molding" as used herein refers to that manufacturing process wherein plastic or other molten material is formed by injection into a mold, in which is positioned a separate element to be embedded in the molded material and about which the plastic material flows during the molding operation, such that the final molded product includes the element inserted into the mold prior to injection of plastic or molded material thereto.

With this background, it should be understood that one difficulty in the insert molding of an ink stylus tube, typically a small diameter metal tube, in a small plastic body for an instrument marker pen is the means for securely and permanently attaching the tube in the molded body so that it will not be dislodged from its proper position during subsequent handling, storage, installation or use. To this end, it is known that one manufacturer has formed longitudinal serrations on the outer surface of the ink stylus tube to better resist torsional stress about the periphery of the tube, which might tend to twist the tube within its placement in the instrument pen marker body. This, however, does not sufficiently preclude longitudinal displacement of the tube.

Though not in the instrument pen marker field, U.S. Pat. No. 3,804,540-Mutschler discloses a hand held writing instrument, wherein a metal holder and positioner for a relatively fragile writing nib is positioned and anchored in a plastic body by means of "arms 2, 3, which on molding of the plastic material abut against the nib 7 in the reservoir 8 and serve as an anchoring connection between the plastic part and the metallic sleeve". (Column 3, lines 4–8)

Notwithstanding such prior products and patents, there remained a need, prior to the present invention, for more effectively and more reliably securing an ink stylus tube in an instrument pen marker body.

The objective of the present invention is to provide such a more secure and more effective means for manufacturing, and the product of that manufacture, an instrument marker pen with a securely attached ink stylus tube, all of a design suitable for use in the tight dimensional constraints of modern instrument marker pens.

This objective is met, in accordance with the present invention, by an instrument marker pen having an ink stylus tube embedded therein, the embedded portion of the tube including an anchoring projection secured thereto.

Preferably, the body of the marker pen of this invention is a plastic material which is insert molded about a metal ink stylus tube, that portion of the ink stylus tube embedded therein also including an anchoring projection preferably a metal projection welded to the outer surface of the tube and including a "U-shaped" portion conforming to a part of the outer surface of the tube and having flanges extending away from the tops of the legs thereof so as to secure the tube by resisting both torsional and longitudinal stresses.

For a better understanding of the present invention, reference may be made to the following detailed description thereof taken in conjunction with the appended claims and the accompanying drawings, in which:

Figure 1:
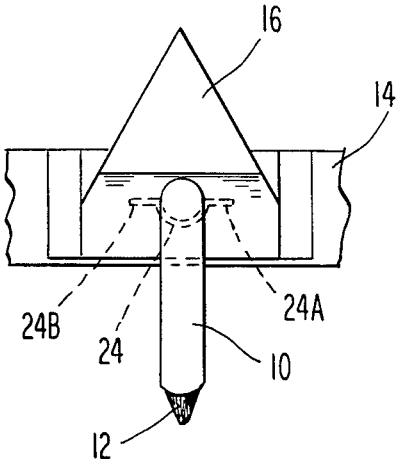
FIG. 1 is a partial head end view of an instrument marker pen comprising the preferred embodiment of the present invention.
Figure 2:
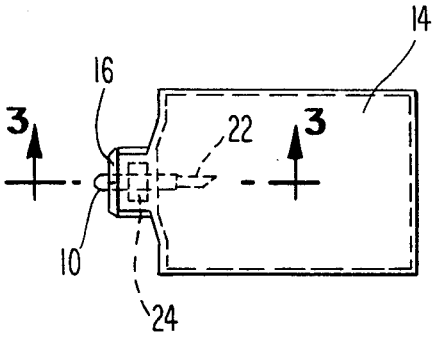
FIG. 2 is a top view of the pen shown in FIG. 1.
Figure 3:
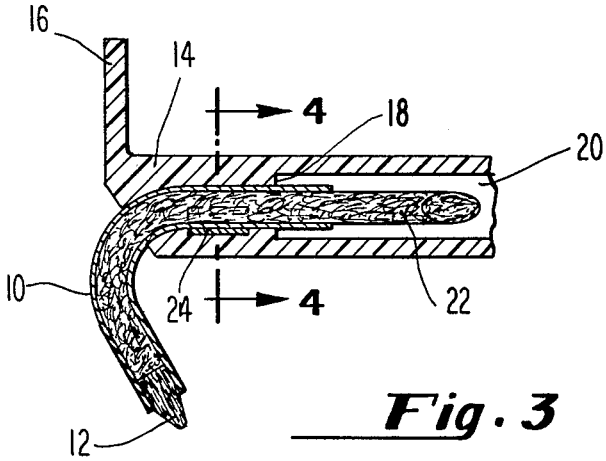
FIG. 3 is a longitudinal sectional view taken in the plane 3—3 of FIG. 2, of the same pen.
Figure 4:
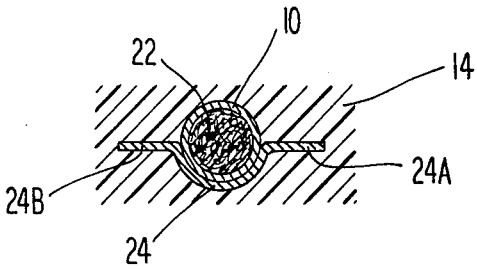
FIG. 4 is a cross-sectional view, in the plane 4—4 of the pen shown in FIG. 3.

Referring in general to the figures, there is shown an instrument marker pen including a projecting ink stylus tube 10 and a porous writing nib 12 disposed at the end thereof, tube 10 projecting from a marker body 14 with a molded pointer shape 16 at the outer face thereof for visual indication of instrument position.

Rearwardly of pointer 16, body 14 includes a stylus tube passageway 18 and an ink reservoir space 10. The non-projecting portion of tube 10 is embedded in passageway 18 and extends into reservoir 20. Disposed within tube 18 is an ink wicking capillary material 22, which in accordance with one embodiment of the present invention, is of intermediate capillarity between that of a reservoir material (not shown) disposed in reservoir space 20 and porous nib 12.

In accordance with the present invention and to secure tube 10, in its embedded portion, in marker body 14, tube 10 has attached to it, along that portion of its length which is embedded in body 14, an anchoring projection 24, consisting of a "U-shaped portion 24A" which conforms to a section of the outer surface of tube 10 and outwardly extending flanges 24B at the tops of the legs of the "U-shaped portion 24A." Anchoring projection 24 in this preferred embodiment of the invention is metal and is welded to the outer surface of the metal tube 10.

Obviously, other materials of construction could be used and the anchoring projection could take a number of other geometric configurations. Adhesive bonding or other attachment means may also be used instead of welding.

In the method of the present invention, the instrument marker pen with securely attached ink stylus tube consists of first attaching an anchoring projection to that portion of the stylus tube to be engaged in the marker body and then insert molding the marker body, preferably by injection molding of plastic into a mold in which has first been placed the ink stylus tube with anchoring projection secured thereto, permitting the plastic to flow about at least a portion of the ink stylus tube and particularly that portion including the anchoring projection. In this process, the product is a marker body, from which projects an ink stylus tube, the non-projecting portion of the stylus tube being embedded in the marker body and the embedded portion including an anchoring projection to resist both torsional and longitudinal stress which might otherwise tend to displace the tube from its proper position within the marker body.

While this invention has been described with respect to a specific embodiment thereof, it is not limited thereto. Rather, the appended claims are intended to be construed to encompass not only those embodiments of the invention described and suggested but such other embodiments of the invention which may be developed by those skilled in the art without departing from the true spirit and scope thereof.

Having described my invention, that which I desire to claim and secure by Letters Patent is the following:

1. Insert molded instrument marker pen having a stylus tube and a pen body, a portion of said tube being embedded along a length of said tube in said body, said portion including at an intermediate point along said embedded length, an embedded anchoring projection attached to the outer surface of said tube, said anchoring projection, in cross-sectional shape, being a "U", the curvature of which corresponds to the outer curvature of said tube, said "U" having flanges at the upper ends thereof extending radially outwardly from said tube.

2. Marker pen, as recited in claim 1, wherein the cross-sectional shape of said body surrounding said anchoring projection extends outwardly at least the lengths of said flanges, and perpendicularly thereto is of substantially smaller dimension.

3. Marker pen, as recited in any of claims 1, or 2, wherein said body is composed of plastic material insert molded about said stylus tube.

4. Marker pen as recited in claim 3 wherein said stylus tube is metal and said anchoring protection is metal and is secured to said tube by welding.

5. Marker pen as recited in claim 3 further including an ink wicking material extending through said tube and a capillary writing nib inserted in said tube at the end thereof.

6. Marker pen, as recited in any of claims 1 or 2, wherein said stylus tube is metal and said anchoring projection is metal and is secured to said tube by welding.

7. Marker pen as recited in claim 6 further including an ink wicking material extending through said tube and a capillary writing nib inserted in said tube at the end thereof.

8. Marker pen, as recited in any of claims 1, or 2, further including an ink wicking material extending through said tube and a capillary writing nib inserted in said tube at the end thereof.

9. Method for making an instrument marker pen comprising securing to an ink stylus tube an anchor, consisting of a first portion engaging a section of the outer surface of said tube and a second portion extending away from said outer surface, and insert molding a marker body about said tube, with one end of said tube projecting therefrom and said anchor embedded in the insert molded material of which said body is composed, providing a generally "U" shaped outer surface for said first portion and providing said second portion with a pair of flanges attached to the tops of two legs of said "U" shaped portion.

10. Method, as recited in claim 9, wherein said anchor and said tube are metal and said anchor is secured to said tube by welding.

* * * * *